United States Patent [19]

Zink

[11] Patent Number: 4,664,318

[45] Date of Patent: May 12, 1987

[54] CONE CRUSHER

[75] Inventor: Franz Zink, Liezen, Austria

[73] Assignee: Voest-Alpine Aktiengesellschaft, Austria

[21] Appl. No.: 723,898

[22] Filed: Apr. 16, 1985

[30] Foreign Application Priority Data

Apr. 27, 1984 [AT] Austria ..... 1411/84

[51] Int. Cl.[4] ..... B02C 25/00

[52] U.S. Cl. ..... 241/37; 241/213

[58] Field of Search ..... 241/207–216, 241/37

[56] References Cited

U.S. PATENT DOCUMENTS 3,700,175 10/1972 Saito ..... 241/37

*Primary Examiner*—Mark Rosenbaum

*Attorney, Agent, or Firm*—Cushman, Darby & Cushman

[57] ABSTRACT

In a cone crusher comprising a breaking cone (1) arranged for being driven to effect a tumbler movement or pendulum movement within the interior of a hollow-conical breaking surface (2) of a stator (3), the gap width (16, 16') is adjustable by axial displacement of the breaking cone (1) and determinable by measuring the lifted position of the breaking cone (1) by means of a displacement pickup (21) acting on the breaking cone (1). An axle extension (6) is connected with the tapered end of the breaking cone (1) and is bearingly supported within a bearing (7) fixed on the stator (3) and allowing the tumbler movement or the pendulum movement, respectively, noting that the displacement pickup (21) acts on the axle extension (6).

1 Claim, 3 Drawing Figures

CONE CRUSHER

The invention refers to a cone crusher, in which the frustum-shaped breaking cone is driven for effecting a tumbler movement or pendulum movement, respectively, within a stator provided with a hollow-conical breaking surface and in which the width of the gap between the breaking cone and the hollow-conical breaking surface of the stator can be varied by axial displacement of the breaking cone, noting that an axle entension is adjoining the tapered end of the breaking cone and is bearingly supported within a bearing fixed on the stator and allowing the tumbler movement or pendulum movement, respectively. In such a cone crusher, the gap existing at the circumference of the breaking cone between the breaking cone and the hollow-conical breaking surface of the stator is—on account of the tumbler or pendulum movement of the breaking cone—reduced to a smallest width which defines the grain size of the crushed material. This smallest gap width results from the lifted position assumed by the breaking cone. This lifted position and thus the smallest gap width could up till now not be determined without difficulties. The lowermost position of the breaking cone and its topmost position is defined by means of stops and the desired lifted position and thus the desired grain size could up till now be selected in an only hazardous manner by adjusting the lifted position of the breaking cone by an adjusting movement starting from the stops. Exact adjustment of the grain size of the crushed material could not be effected in this manner.

In existing plants, either the oil level within the oil tank of the hydraulic system for adjusting the cone crusher is measured thereby obtaining correspondingly inaccurate measured values or the displacement pickup is mounted within the adjusting cylinder. In this case, disassembling and assembling is expensive in case of maintainance work. Susceptibility to troubles is, however, particularly great because the displacement pickup is arranged within the pressurized space of the cylinder where occur very high pressure shocks.

It is an object of the invention to provide the possibility to adjust in a simple manner the grain size of the crushed material. For solving this task, the invention essentially consists in that the gap width can be determined by measuring the lifted position of the breaking cone by means of a displacement pickup acting on the breaking cone. In this manner it is made possible to predetermine the grain size of the crushed material by adjusting the lifted position in correspondence with the measured values supplied by the displacement pickup. The drive means imparting the eccentric movement of the breaking cone acts on the lower end of the shaft of the breaking cone and lifting of the breaking cone is effected by means of a piston-cylinder-aggregate which is subject to considerable forces. The position of the piston within the piston-cylinder-aggregate can not be determined forthwith or without difficulties. The axis of the breaking cone is located within the area of the eccentric drive means and within a cavity which is flown through by the crushed material and is thus only with difficulties accessible for arranging therein a displacement pickup irrespective of the fact that the shaft performs strong eccentric movements within this area. Therefore and according to a preferred embodiment of the invention, the displacement pickup acts on the axle extension. This axle extension performs only minor radial movements, so that a point of attack arranged at this location for the displacement pickup results in substantially unadulterated measured values. A mechanical displacement pickup is comparatively complicated and reading of its display is difficult, because this axle extension is located within that space through which the cone crusher is charged. According to a further preferred embodiment of the invention, the displacement pickup is consequently an electrical displacement pickup, in particular an inductive or capacitive displacement pickup. The measuring result of such a displacement pickup can be made discernible without difficulties.

According to the invention and according to a preferred embodiment, a plunger-type armature is connected with the axle extension and is dipping into a stationary component, in particular a coil, of the displacement pickup. On account of the plunger-type armature being arranged for dipping into a stationary component of the displacement pickup, connection of electrical conduits to this stationary component of the displacement pickup is possible in a simple manner.

According to the invention, that component of the displacement pickup which is connected with the axle extension is supported on the axle extension for being universally pivotable, so that the tumbler movements can be compensated which are, however, comparatively small within the area of the axle extension. For the same purpose and according to the invention, that component of the displacement pickup which is connected with the axle extension is conveniently formed of a flexible rod.

According to a preferred embodiment of the invention, the point of attack of the displacement pickup on the axle extension is located approximately within the pendulum center of the breaking cone. If this point of attack is located exactly in the pendulum center of the breaking cone, one can do with a displacement pickup connected to the axle extension in a manner allowing universal movement. However, the breaking cone can be adjusted in height direction, so that the pendulum center does not precisely coincide with the point of attack of the displacement pickup on the axle extension in all lifted positions of the breaking cone. In this case, the required compensation is made possible by the flexible rod. The axle extension of the breaking cone is guided within a bearing and the pendulum center is located within the area of this bearing. For the purpose of arranging the point of attack approximately in the pendulum center of the breaking cone, the point of attack of the displacement pickup on the axle extension is, according to the invention, conveniently located within a central bore of the axle extension, noting that preferably also at least part of the displacement pickup is located within this central bore.

A particularly simple construction and assembling operation results in this case if, according to the invention, the displacement pickup is arranged within a bushing inserted into a central bore of the axle extension and fixed in position within the axle extension. An insert member can, according to the invention, be inserted into the bushing from its bottom side, which insert member has within a cavity a crowned bearing within which the component, which is connected with the axle extension, of the displacement pickup is supported for being universally swivellable and for being obstructed from exerting an axial shifting movement, noting that said cavity is filled with a viscous liquid, in particular oil, and is closed on top by an elastic plate member. This results in a particularly simple assembling operation, and on account of the cavity being filled with a viscous liquid, there results a good damping of vibrations. If this viscous liquid is oil, also lubrication of the crowned bearing is obtained.

Preferably and according to the invention, a housing closed in all round is centrically arranged within the stator and rigidly connected with the stator, said housing carrying the bearing for the axle extension and enclosing the displacement pickup, noting that an annular space for supplying the material to be crushed is provided between the housing and the upper portion of the stator. This results in a closed construction in which the displacement pickup is protected within the housing and can not be damaged by the supplied material to be crushed. On account of the fact that the electrical conduit for the displacement pickup must be passed through the annular space through which the material to be crushed is supplied, it is, according to the invention, convenient that this electrical conduit is guided within the area of this annular space in an armor tube which is preferably protected by a roofing.

The invention is schematically illustrated in the drawing by an example of embodiment.

In the drawing

Figure 1:
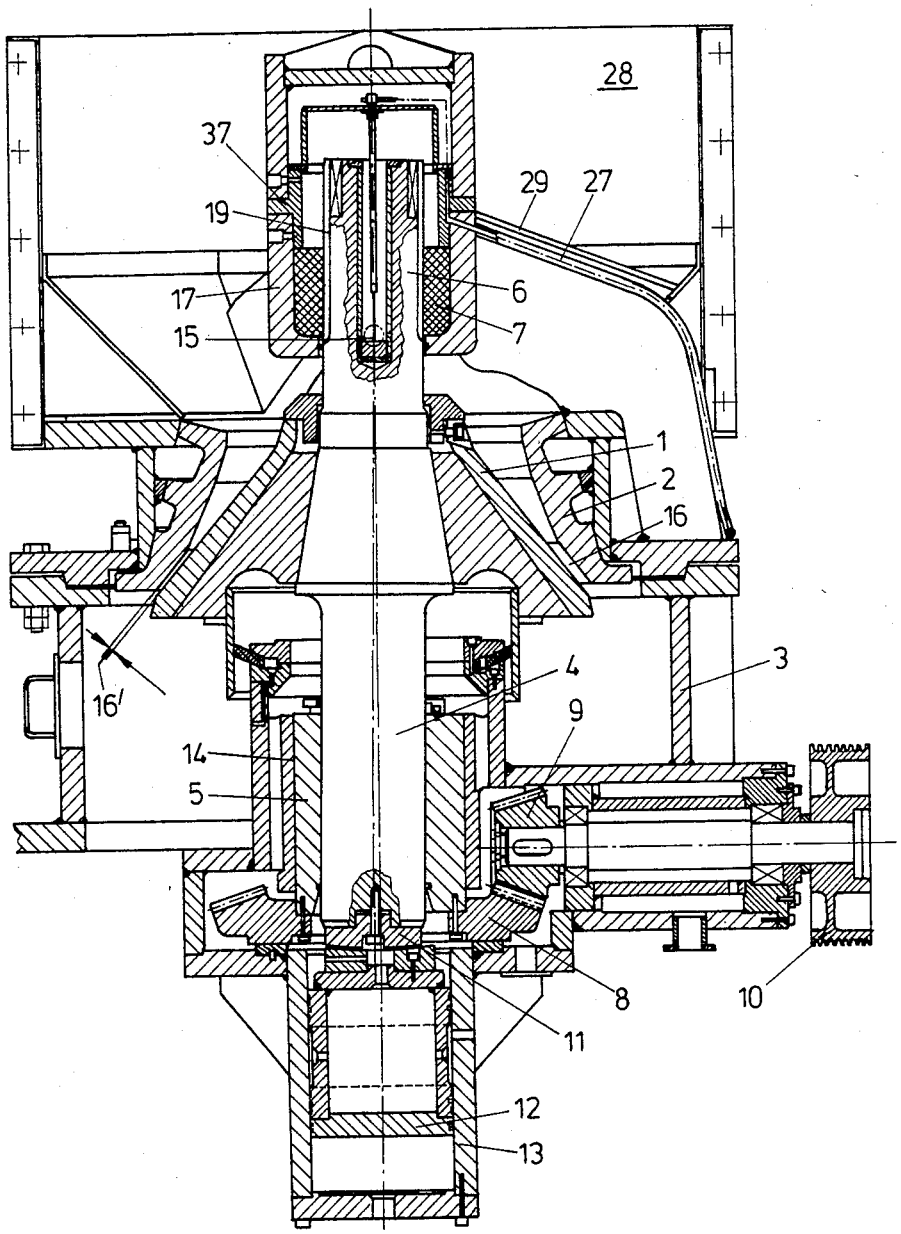
FIG. 1 shows an axial section through the cone crusher.

1 is the breaking cone, which performs a tumbler movement or pendulum movement, respectively, within a hollow-conical breaking surface 2 which is rigidly connected with the stator 3. The drive axis 4 of the breaking cone 1 is bearingly supported on the stator 3 within an eccentric bushing 5. An axle extension 6 is arranged at the upper end of the breaking cone and is bearingly supported within a bearing 7. The eccentric bushing 5 is non-rotatably connected with a spur bevel gear 8 which is driven by a pinion 9. 10 is a belt pulley for driving the pinion 9. The axis 4 is supported against the piston 12 of a lifting cylinder 13 by means of a crowned support 11 and can be lifted and lowered by means of this piston 12. The eccentric bushing is rotatably supported within the stator 3 at 14. During rotation of the eccentric, the axis 4 is only taken along for effecting a pendulum movement. The axis 4 can be rotatable within the eccentric bushing 5, but is not driven for effecting a rotation. When rotating the eccentric bushing 5, the breaking cone 1 performs a pendulum movement together with the axis 4 and the axle extension 6, the pendulum center being designated 15. The bearing 7 consists of elastic synthetic plastics material and allows this pendulum movement. The conical gap between the breaking cone 1 and the hollow-conical breaking surface 2 is designated with 16. The smallest gap width is designated by 16'. This gap width is obtained in the position shown in the drawing. If the breaking cone 1 is lifted by the piston 12, the width of this gap 16 is reduced. If the breaking cone is lowered by the piston 12, the width of the gap 16 is increased.

Figure 2:
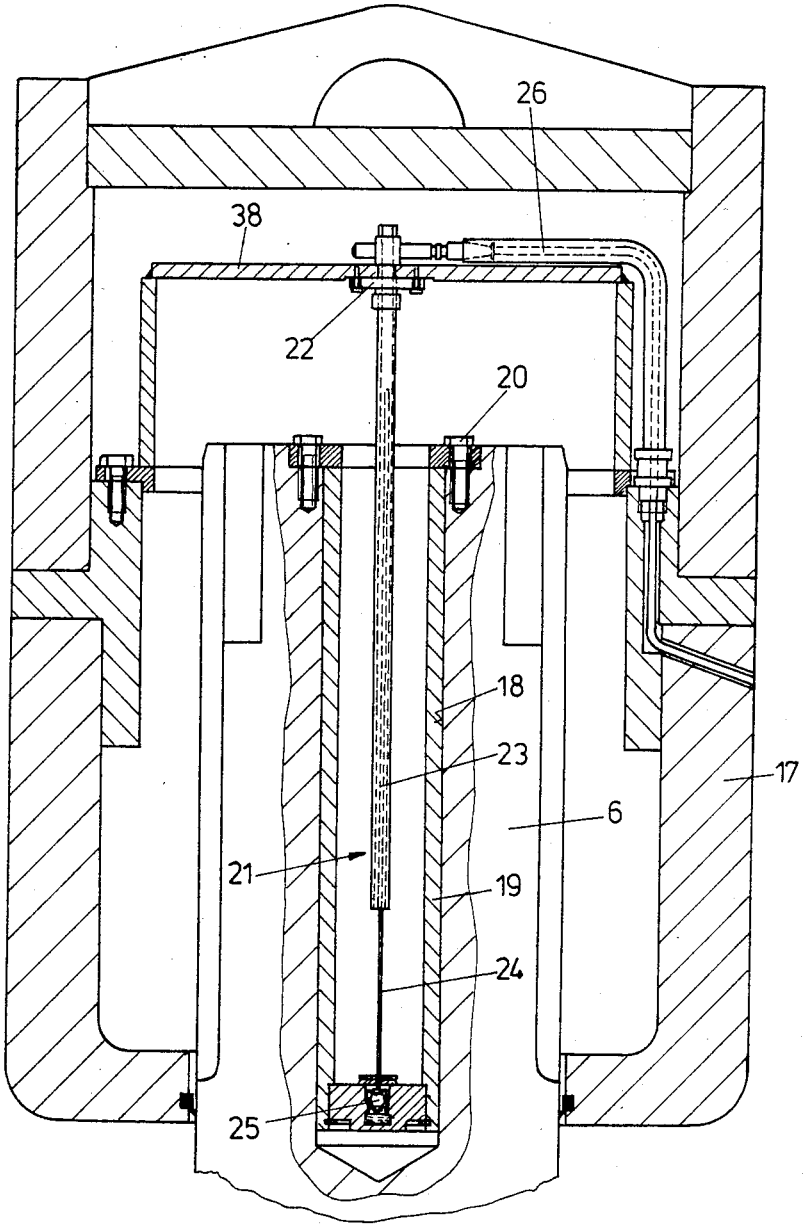
FIGS. 2 and 3 show details in an enlarged scale.

The bearing 7 is arranged within a housing 17 rigidly connected with the stator 3. In a centrical bore 18 of the axle extension 6, there is, as is shown in FIG. 2 in a greater scale, inserted a bushing 19, which is screwedly connected with the axle extension 6 by means of screws 20. A displacement pickup 21 is arranged within this bushing and consists of a tubular part 23, which is stationarily fixed at 22 and into which a plunger-type armature 24 dips, which is linked to the axle extension 6 at 25. In case of an inductive displacement pickup, the mentioned tubular part 23 comprises current-carrying windings, so that the dipping depth into this tubular part 23 provides the measuring result and indicates the lifted position of the breaking cone 1. An electrical conduit 26 comes from this tubular part 23 and is passed within an armor tube 27 through the annular charging space 28 for the material to be crushed. The armor tube 27 is additionally protected against lumps of rock by a roofing 29.

Figure 3:
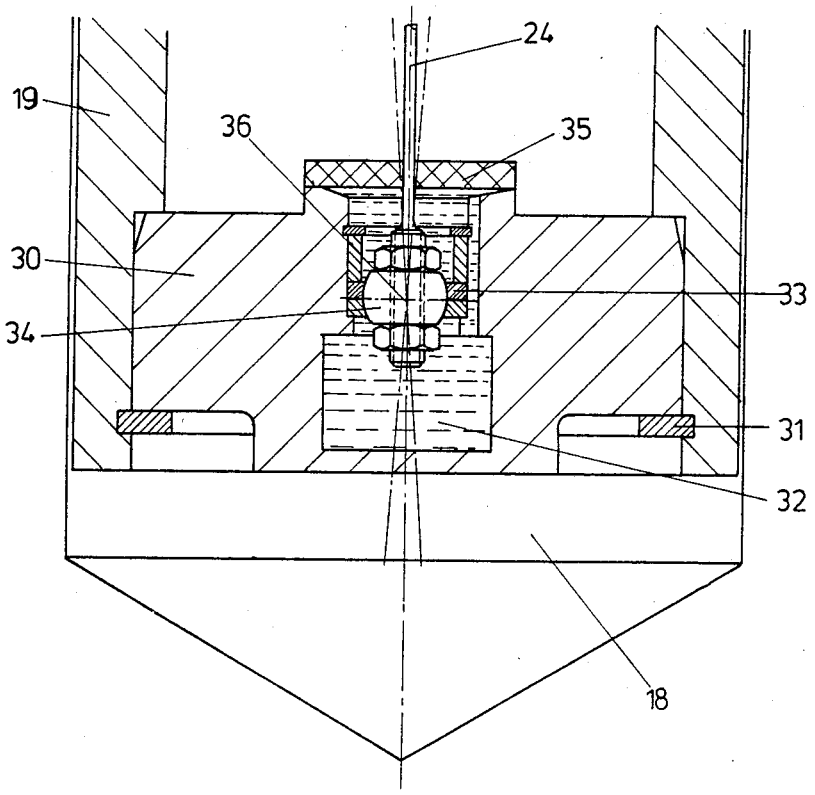

An insert member 30 is inserted into the lower end of the bushing 19 (see FIG. 3) and secured in its position by a circlip 31. The insert member 30 has a cavity 32, within which a crowned bearing 33 is arranged, having screwedly connected with its spherical part 34 the plunger-type armature 24. The cavity 32 is filled with a viscous liquid and covered by an elastic plate member 35, for example of rubber or synthetic plastics material. This viscous liquid provides a damping effect and also lubrication of the crowned bearing 33, 34. The center of swivelling movement of the plunger-type armature 24, which center is defined by the bearing 33, 34, is designated by 36. In the shown position of the breaking cone 1, this center 36 of swivelling movement approximately coincides with the center 15 of pendulum movement. On account of the breaking cone 1 being arranged for being lifted and lowered, the center 36 of swivelling movement of the plunger-type armature does not coincide in all positions with the center 15 of the pendulum movement of the breaking cone 1. This is, however, compensated on account of the plunger-type armature 24 consisting of a flexible rod or on account of this plunger-type armature being arranged on a flexible rod.

For assembling purposes, the housing 17 is a two-part housing. An insert ring 37 maintains the bearing 7 in its position. The fixing area 22 for the tubular part 23 of the displacement pickup 21 is located on a bracket 38 rigidly connected with the housing 17.

What is claimed is:

1. A cone crusher comprising a frustum-shaped breaking cone driven for effecting a tumbler movement or pendulum movement within a stator provided with a hollow-conical breaking surface, the width of the gap between the breaking cone and the hollow-conical breaking surface of the stator being variable by axial displacement of the breaking cone, an axle extension adjoining the tapered end of the breaking cone and bearingly supported within a bearing fixed on the stator and allowing the tumbler movement or pendulum movement, and a displacement pickup for determining the width of said gap by measuring the lifted position of the cone, said pickup including a flexible rod extending in the direction of axial displacement of the cone and having an end attached to the axle extension for movement with the extension and pivoted to the extension for universal pivotable movement relative to the extension, said pickup also including stationary means for measuring the position of said rod, wherein the point of attachment of the rod to the axle extension is located within a central bore of the axle extension, at least a part of the rod being located within the central bore, wherein said rod is arranged within a bushing fixed within said axle extension, wherein an insert member is inserted into the bushing from its bottom side, which insert member has within a cavity a crowned bearing within which said rod is supported for being universally swivellable and for being obstructed from exerting an axial shifting movement, that said cavity being filled with a viscous liquid and is closed on top by an elastic plate member.

* * * * *